United States Patent [19]

Nakama

[11] Patent Number: 4,753,622

[45] Date of Patent: Jun. 28, 1988

[54] BUILDING BLOCK KIT

[76] Inventor: Yoshitsugu Nakama, 185 Broadway, Brooklyn, N.Y. 11211

[21] Appl. No.: 104,088

[22] Filed: Oct. 5, 1987

[51] Int. Cl.[4] ..... A63H 33/04; E04B 5/04

[52] U.S. Cl. ..... 446/85; 52/608

[58] Field of Search ..... 273/157 R, 160; 446/85, 446/124, 901; 52/608, 609

[56] References Cited

U.S. PATENT DOCUMENTS

| | | | |
|---|---|---|---|
| 907,203 | 12/1908 | Walker | 273/157 R |
| 1,106,162 | 8/1914 | Rothig | 446/901 |
| 1,430,557 | 10/1922 | Jervis | 273/157 R |
| 1,656,199 | 1/1928 | Hodgson | 446/901 |
| 3,396,504 | 8/1968 | Oliveira | 52/608 |
| 4,121,831 | 10/1978 | Greene | 273/160 |
| 4,210,333 | 7/1980 | Shanin | 273/157 R |
| 4,537,001 | 8/1985 | Uppström | 273/157 R |
| 4,602,908 | 7/1986 | Kroeber | 446/124 |

*Primary Examiner*—Robert A. Hafer
*Assistant Examiner*—Michael Brown
*Attorney, Agent, or Firm*—Norman B. Rainer

[57] ABSTRACT

A set of building blocks is provided, each of identical size and shape. The block is of monolithic structure of elongated prismatic shape bounded by six flat faces and having an isosceles trapezoidal cross-sectional configuration. When properly arranged, interesting built structures are produced, especially when the faces of the blocks are of different colors.

6 Claims, 2 Drawing Sheets

BUILDING BLOCK KIT

BACKGROUND OF THE INVENTION

This invention concerns a collection of blocks which may be assembled to form a variety of aesthetically pleasing structures.

The use of cubical building blocks by children for amusement and educational purposes has long been known. The building blocks not only develop manipulative dexterity, but stimulate creative expression, and produce an enchanced perception of geometrical aspects of structure, design and pattern.

Sets of cubical building blocks, however, are limited in terms of the variety of structures and designs that can be produced. Because the six sides of the cube are equal, no distinction between the sides is necessitated. Accordingly, the cubical blocks offer little challenge to more innovative persons. Although non-cubical building blocks have been disclosed, their shapes have usually caused manipulative difficulties or high manufacturing cost.

It is consequently an object of the present invention to provide a set of building blocks capable of producing a greater variety of structures than a set of an equal number of cubical building blocks.

It is another object of this invention to provide a set of building blocks as in the foregoing object offering greater challenge of use without increased manipulative difficulty.

It is a further object of the present invention to provide a set of building blocks of the aforesaid nature amenable to low cost manufacture.

These objects and other objects and advantages of the invention will be apparent from the following description.

SUMMARY OF THE INVENTION

The above and other beneficial objects and advantages are accomplished in accordance with the present invention by a multitude of blocks of identical size and shape, said block being a momolithic structure of elongated prismatic shape bounded by six flat faces intersecting at sharply defined corner edges, two of said faces being end surfaces in spaced apart parallel relationship in perpendicular disposition to the direction of elongation, a third face being a bottom surface extending perpendicularly between said end surfaces, a fourth face being a top surface disposed above said bottom surface in parallel relationship thereto and extending between said end surfaces, the fifth and sixth faces being side surfaces in opposed upwardly convergent juxtaposition between said bottom and top surfaces, the cross-sectional configuration of said block taken in the direction perpendicular to the direction of elongation being constant throughout the block, said configuration being an isosceles trapezoid having upper and lower boundary lines corresponding to said upper and lower surfaces, and side boundary lines corresponding to said side surfaces, the angles between the lower and side boundary lines being 60 degrees, and the angles between the upper and side boundary lines being 120 degrees, the lengths of the upper and side boundary line being equal, the length of the bottom boundary line being twice the length of the upper boundary line, and the length of the block, measured perpendicularly between said end surfaces being three times the length of said upper boundary line.

In preferred embodiments, the multitude of blocks comprises between about 12 and 120 blocks, and is marketable as such as a packaged kit. The six faces of the block may each have a different color, solid colors being preferable. In other embodiments, all or several of the faces may have the same color. Transparent plastic boxes may be included with the kit, having shapes adapted to confine structures assembled from the blocks. Such blocks may be made from polyacrylate panels interadhered at their edges.

For ease of description, one face has been described as a top face and another a bottom face. In reality, however, the blocks may be employed in any orientation. The top, bottom and side faces may also be referred to as the long faces of the block. Each long face has a rectangular perimeter. In most of the structures which may be assembled from the blocks, the long faces will lie in abutment with at least one edge of contiguous blocks being in coextensive close proximity.

BRIEF DESCRIPTION OF THE DRAWING

For a fuller understanding of the nature and objects of the invention, reference should be had to the following detailed description taken in connection with the accompanying drawing forming a part of this specification and in which similar numerals of reference indicate corresponding parts in all the figures of the drawing.

DESCRIPTION OF THE PREFERRED EMBODIMENT

Figure 1:
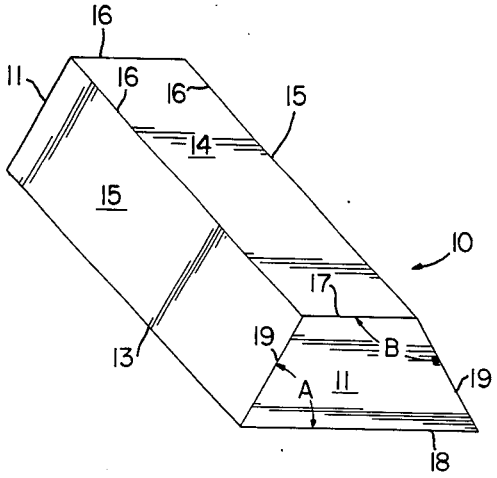
FIG. 1 is a perspective view of the building block of the present invention.
Figure 2:
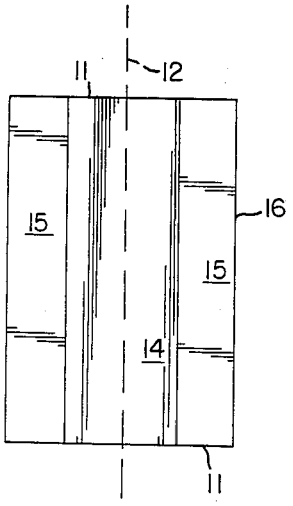
FIG. 2 is a top view thereof.

Referring to FIGS. 1 and 2, an embodiment of the building block 10 of this invention is shown as a monolithic structure of elongated shape bounded by two end surfaces 11 in spaced apart parallel relationship in perpendicular disposition to the direction of elongation 12, a bottom surface 13 extending perpendicularly between said end surfaces, a top surface 14 disposed above said bottom surface in parallel relationship thereto and extending between said end surfaces, and side surfaces 15 in opposed upwardly convergent juxtaposition between said bottom and top surfaces.

The aforesaid six surfaces or faces intersect at sharply defined corner edges 16. The cross-sectional configuration of said block, taken in the direction perpendicular to the direction of elongation, is constant throughout the block, said configuration being an isosceles trapezoid having upper and lower boundary lines 17 and 18, respectively, corresponding to said upper and lower surfaces, respectively, and side boundary lines 19 corresponding to said side surfaces.

The angle between the lower and side boundary lines 18 and 19, respectively, designated as angle A in FIG. 1, is 60 degrees. The angle between the upper and side boundary lines 17 and 19, respectively, designated as angle B in FIG. 1, is 120 degrees. The lengths of the upper and side boundary lines are equal. The length of lower boundary line 18 is twice the length of upper boundary line 17. The length of the block, measured perpendicularly between end surfaces 11, is three times the length of upper boundary line 17.

Figure 3:
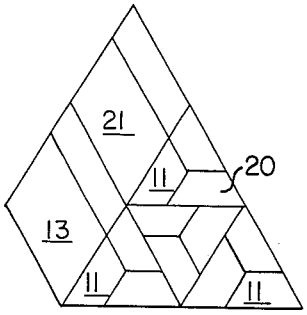
FIGS. 3–7 are perspective views of various assemblies that may be produced with a multitude of said blocks.

FIG. 3 illustrates a structure assembled from twelve of the above-described blocks. By virtue of the specialized geometry of the basic block, the structure is held together by gravity and the frictional interaction of the long top, bottom and side surfaces, 14, 13 and 15, respectively. Front surface 20 of the structure of FIG. 3 is comprised of end surfaces 11, and has an isosceles triangular perimeter. Because of color variations in end surfaces 11, front surface 20 can be made to have differently patterned appearances. Each side surface 21 of the structure of FIG. 3, having a rectangular perimeter, is comprised of long surfaces of the blocks, and can have a varied color pattern.

Figure 5:
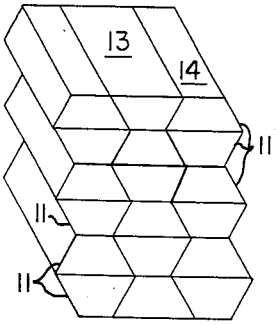
Figure 6:
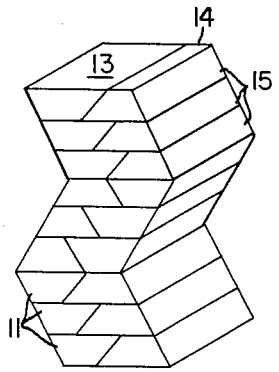

The structures shown in FIGS. 5 and 6 are made in analogous manner to the structure of FIG. 3, namely by horizontal alignment of all the blocks.

Figure 4:
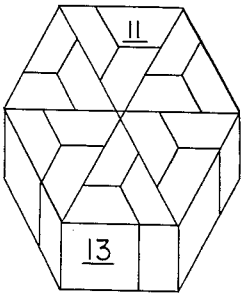
Figure 7:
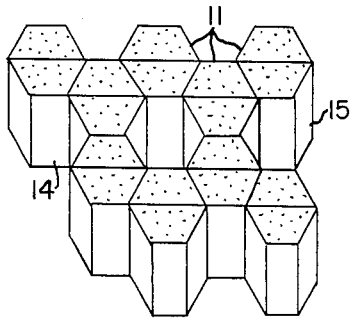
Figure 8:
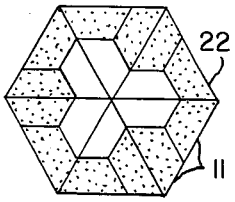
FIGS. 8–11 are plan views of additional assemblies showing by means of shading different color patterns achievable within the same hexagonal perimeter.
Figure 9:
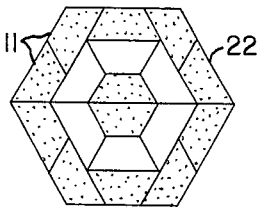
Figure 10:
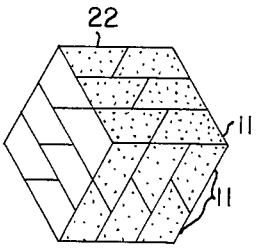
Figure 11:
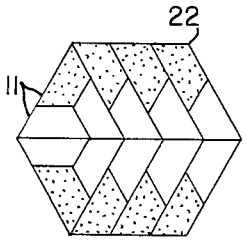

FIGS. 4 and 7 are perspective views of structures made wherein all the blocks are vertically oriented, namely resting upon their end surfaces.

FIGS. 8–11 are top plan views of the upper faces 22 of structures made by vertical orientation of the blocks, and having the same hexagonal upper face perimeter. By suitable variation in the arrangement of the blocks and in their colors, the several exemplary patterns are produced.

The blocks may be fabricated of wood, plastic, metal or other inexpensive, durable material amenable to easy fabrication. The long surfaces of the block may be provided with means to enhance frictional interaction. Such means may include roughened or patterned surfaces or engaging mechanisms.

A contoured transparent box, having the shape of a structure which can be produced by the blocks, may be utilized as a packaging container for the multitude of blocks.

While particular examples of the present invention have been shown and described, it is apparent that changes and modifications may be made therein without departing from the invention in its broadest apsects. The aim of the appended claims, therefore, is to cover all such changes or modifications as fall within the true spirit and scope of the invention.

Having thus described my invention, what is claimed is:

1. A collection of blocks which may be assembled to form a variety of aesthetically pleasing structures comprising a multitude of blocks of identical size and shape, each said block being a monolithic structure of elongated prismatic shape bounded by six flat faces intersecting at sharply defined corner edges, two of said faces being end surfaces in spaced apart parallel relationship in perpendicular disposition to the direction of elongation, a third face being a bottom surface extending perpendicularly between said end surfaces, a fourth face being a top surface disposed above said bottom surface in parallel relationship thereto and extending between said end surfaces, the fifth and sixth faces being side surfaces in opposed upwardly convergent juxtaposition between said bottom and top surfaces, the cross-sectional configuration of said block taken in the direction perpendicular to the direction of elongation being constant throughout the block, said configuration being an isosceles trapezoid having upper and lower boundary lines corresponding to said upper and lower surfaces, and side boundary lines corresponding to said side surfaces, the angles between the lower and side boundary lines being 60 degrees, and the angles between the upper and side boundary lines being 120 degrees, the lengths of the upper and side boundary line being equal, the length of the bottom boundary line being twice the length of the upper boundary line, and the length of the block, measured perpendicularly between said end surfaces being three times the length of said upper boundary line.

2. The collection of blocks of claim 1 wherein said multitude comprises between about 12 and 120 blocks.

3. The collection of claim 2 as a packaged kit.

4. The collection of claim 3 wherein said blocks are packaged within a transparent rigid enclosure conforming to a structure which may be constructed from said blocks.

5. The collection of blocks of claim 1 wherein the faces of each block are of at least two different colors.

6. The collection of blocks of claim 1 wherein the faces of the blocks are provided with means to enhance frictional interaction.

* * * * *